US009645550B2

(12) United States Patent
Corthesy

(10) Patent No.: US 9,645,550 B2
(45) Date of Patent: May 9, 2017

(54) TIMEPIECE PART

(71) Applicant: Yves Corthesy, La Chaux-de-Fonds (CH)

(72) Inventor: Yves Corthesy, La Chaux-de-Fonds (CH)

(73) Assignee: LVMH SWISS MANUFACTURES SA, La Chaux-de-Fonds (CH)

( * ) Notice: Subject to any disclaimer, the term of this patent is extended or adjusted under 35 U.S.C. 154(b) by 116 days.

(21) Appl. No.: 14/361,530

(22) PCT Filed: Nov. 30, 2012

(86) PCT No.: PCT/EP2012/074082
§ 371 (c)(1),
(2) Date: May 29, 2014

(87) PCT Pub. No.: WO2013/079657
PCT Pub. Date: Jun. 6, 2013

(65) Prior Publication Data

US 2014/0321250 A1 Oct. 30, 2014

(30) Foreign Application Priority Data

Dec. 2, 2011 (CH) ..... 1918/11
May 4, 2012 (CH) ..... 624/12

(51) Int. Cl.
*G04B 17/32* (2006.01)
*G04B 18/08* (2006.01)
(Continued)

(52) U.S. Cl.
CPC ..... *G04B 18/08* (2013.01); *G04B 13/02* (2013.01); *G04B 17/285* (2013.01)

(58) Field of Classification Search
CPC .... G04B 13/007; G04B 13/008; G04B 17/20; G04B 17/28; G04B 17/285; G04B 17/32; G04B 18/08
See application file for complete search history.

(56) References Cited

U.S. PATENT DOCUMENTS

2009/0274012 A1* 11/2009 Kasapi ..... G04B 17/285 368/127
2010/0315908 A1* 12/2010 Tran ..... G04B 13/008 368/142

FOREIGN PATENT DOCUMENTS

WO 2009/026735 3/2009

OTHER PUBLICATIONS

International Search Report dated Feb. 22, 2013, corresponding to PCT/EP2012/074082.

(Continued)

*Primary Examiner* — Vit W. Miska
*Assistant Examiner* — Jason Collins
(74) *Attorney, Agent, or Firm* — Young & Thompson

(57) ABSTRACT

A timepiece part, includes a frame having a power source, a housing including a first pivotal movement system and a second pivotal movement system; an escapement set up on a mounting, a first kinematic linkage including a first wheel borne by a first half-shaft from the first pivotal movement system and a second wheel borne by a first half-shaft from the second pivotal movement system, and a second kinematic linkage including a first wheel borne by the second half-shaft from the first pivotal movement system and a second wheel borne by the first or second half-shaft of the second pivotal movement system. One of the wheels borne by the second pivotal movement system is kinematically linked to the power source, and the other wheel borne by the pivotal movement system is stationary relative to the frame.

(Continued)

Both wheels borne by the first system are kinematically linked to a differential.

22 Claims, 5 Drawing Sheets

(51) Int. Cl.
*G04B 17/28* (2006.01)
*G04B 13/02* (2006.01)

(56) References Cited

OTHER PUBLICATIONS

R. Good, "Das Erste >>Doppel-Tourbillon<<"; vol. 2, No. 4, Jan. 1, 1979; pp. 245-252; XP008030140.

* cited by examiner

TIMEPIECE PART

TECHNICAL FIELD

The present invention relates to the field of mechanical horology. It more particularly relates to a timepiece part including a system for correcting the seat of the escapement, aiming to reduce the influence of orientation variations of said timepiece part, on its operation. It comprises a frame bearing an energy source, a chassis comprising a first pivoting system around a first axis, using which a support is pivotably mounted inside said chassis, the first pivoting system comprising two coaxial half-arbors. An escapement is also arranged on the support.

The chassis includes a second pivoting system around a second axis substantially perpendicular to the first, using which the chassis is pivotably mounted in reference to the frame. The second pivoting system comprises two coaxial half-arbors. A half-arbor of the first pivoting system bears a wheel forming a first kinematic chain with a wheel supported by a half-arbor of the second pivoting system.

BACKGROUND OF THE INVENTION

A timepiece part as described above is in particular known from application WO2009/026735. One embodiment is proposed in FIG. 1. More specifically, this document discloses a timepiece comprising at least two articulated supports, a first 10 being articulated relative to the frame along a first axis, the second 12 being articulated in reference to the first support along a second axis orthogonal to the first. The escapement 14 is mounted on the second support and, owing to the articulation, can preserve a substantially stable orientation, preferably substantially horizontal, independently of the position of the frame. "Horizontal orientation" indicates that the planes of the discs are horizontal, and the axes of those discs are vertical.

The timepiece comprises a first transmission gear train 16, kinematically connected to an energy source and bringing that energy to the escapement 14, and a second reference gear train 18, connected to the stationary element of the frame. The two gear trains are arranged in parallel, such that any rotation between the supports and the frame or between the supports themselves, results in an identical rotation of the transmission and reference gear trains.

The timepiece further comprises a reverser system 20 making it possible to cause the last discs of the transmission and reference gear trains to rotate in opposite directions. Lastly, a differential correction device 22 makes it possible to cancel all of the movements of the support to bring only the energy from the energy source to the escapement. In fact, the transmission gear train 16 brings a movement corresponding to the rotation of the supports (R) and the rotation caused by the torque from the energy source (E) to a first input of the differential correction device. The reference gear train 18 also transmits a movement corresponding to the rotation of the supports (R) to the reverser system 20, the latter therefore transmitting a reverse movement (−R) to a second input of the differential correction device. The latter is arranged so as to produce the algebraic average of the first input and the second input (or (R−R+E)/2), such that, at its output, only a rotation caused by the torque from the energy source remains.

Thus, the supports bear the two gear trains, transmission 16 and reference 18, respectively, a reverser system 20 and a differential correction device 22, in addition to the escapement system. The present invention aims to reduce the number of parts supported by the supports and to reduce the volume occupied by the latter.

BRIEF DESCRIPTION OF THE INVENTION

More specifically, the invention relates to a timepiece including:

- a frame bearing an energy source,
- a chassis comprising:
  - a first pivoting system around a first axis, using which a support is pivotably mounted inside the chassis, the first pivoting system comprising first and second coaxial half-arbors, and
  - a second pivoting system around a second axis substantially perpendicular to the first, using which the chassis is pivotably mounted relative to the frame, the second pivoting system comprising first and second coaxial half-arbors,
- an escapement arranged on said support,
- a first kinematic chain comprising:
  - a first wheel supported by the first half-arbor of the first pivoting system,
  - a second wheel supported by the first half-arbor of the second pivoting system, and
- a second kinematic chain comprising:
  - a first wheel supported by the second half-arbor of the first pivoting system,
  - a second wheel supported by the first or second half-arbor of the second pivoting system.

In the timepiece according to the invention, one of the wheels supported by the second pivoting system is kinematically connected to the energy source, and the other wheel supported by that pivoting system is stationary relative to the frame. Furthermore, the two wheels supported by the first pivoting system are kinematically connected with an input of a differential arranged to transmit, at its output, the average of the rotations received at its inputs, said output being kinematically connected to the escapement.

BRIEF DESCRIPTION OF THE DRAWINGS

Other details of the invention will appear more clearly upon reading the following description, done in reference to the following figures.

DETAILED DESCRIPTION OF THE INVENTION

Only the elements related to the invention are shown in the figures. One skilled in the art will know how to adapt the technical teaching provided by this description to a clockwork movement including a frame, an energy source and a going train and motion-work to bring the energy to an escapement and display time information, respectively.

The figures therefore show a chassis 50 that is advantageously defined by a substantially annular armature in order to limit the volume it occupies in its movements, as will be seen hereinafter.

Figure 3:
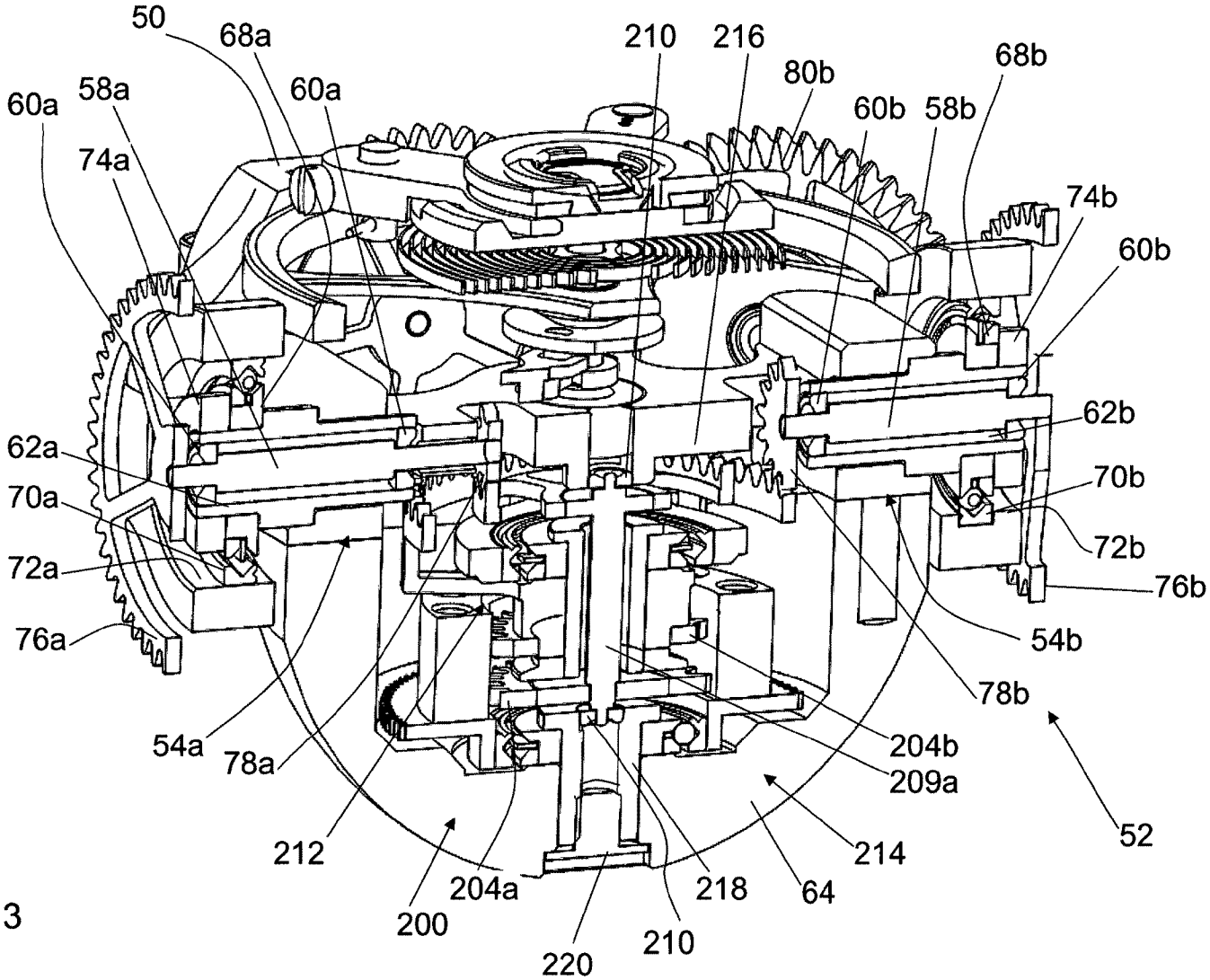
FIGS. 3 and 4 are cross-sectional views, along the two axes of the systems of rotation, of a timepiece part according to the invention, and FIG. 5 proposes a three-dimensional view of an alternative of the invention.

This chassis 50 comprises a first pivoting system 52 around a first axis A-A, more particularly shown in FIG. 3. This first pivoting system 52 comprises two half-arbors 54*a* and 54*b*, positioned coaxially along the axis A-A. The term "half-arbor" is not limiting and must be understood functionally, i.e., it is possible to consider a construction in which the half-arbors are defined by two parts of an arbor, on which the elements that will now be described pivot.

Hereinafter, an index a refers to an element of the half-arbor 54*a* and an index b refers to an element of the half-arbor 54*b*. Each half-arbor 54*a* and 54*b* comprises a shaft 58*a* and 58*b* pivoting on two bearings 60*a* and 60*b* positioned at the ends of a tube 62*a* and 62*b*. The latter are fastened on a support 64 that will be described in more detail below. Each tube 62*a* or 62*b* receives a bearing on its outer perimeter, for example a ball bearing, whereof an inner ring 68*a*, 68*b* is fastened on the tube 62*a*, 62*b* and whereof the outer ring 70*a*, 70*b* is positioned in an opening 72*a*, 72*b* of the chassis 50. A washer 74*a*, 74*b* closes the bearing. This first pivoting system 52 makes it possible to pivot the support 64 inside the chassis 50.

Furthermore, each shaft 58*a*, 58*b* receives, at a distal end in reference to the center of the chassis 50, a wheel 76*a*, 76*b*, and at a second proximal end in reference to the center of the chassis 50, a pinion 78*a*, 78*b*.

Figure 4:
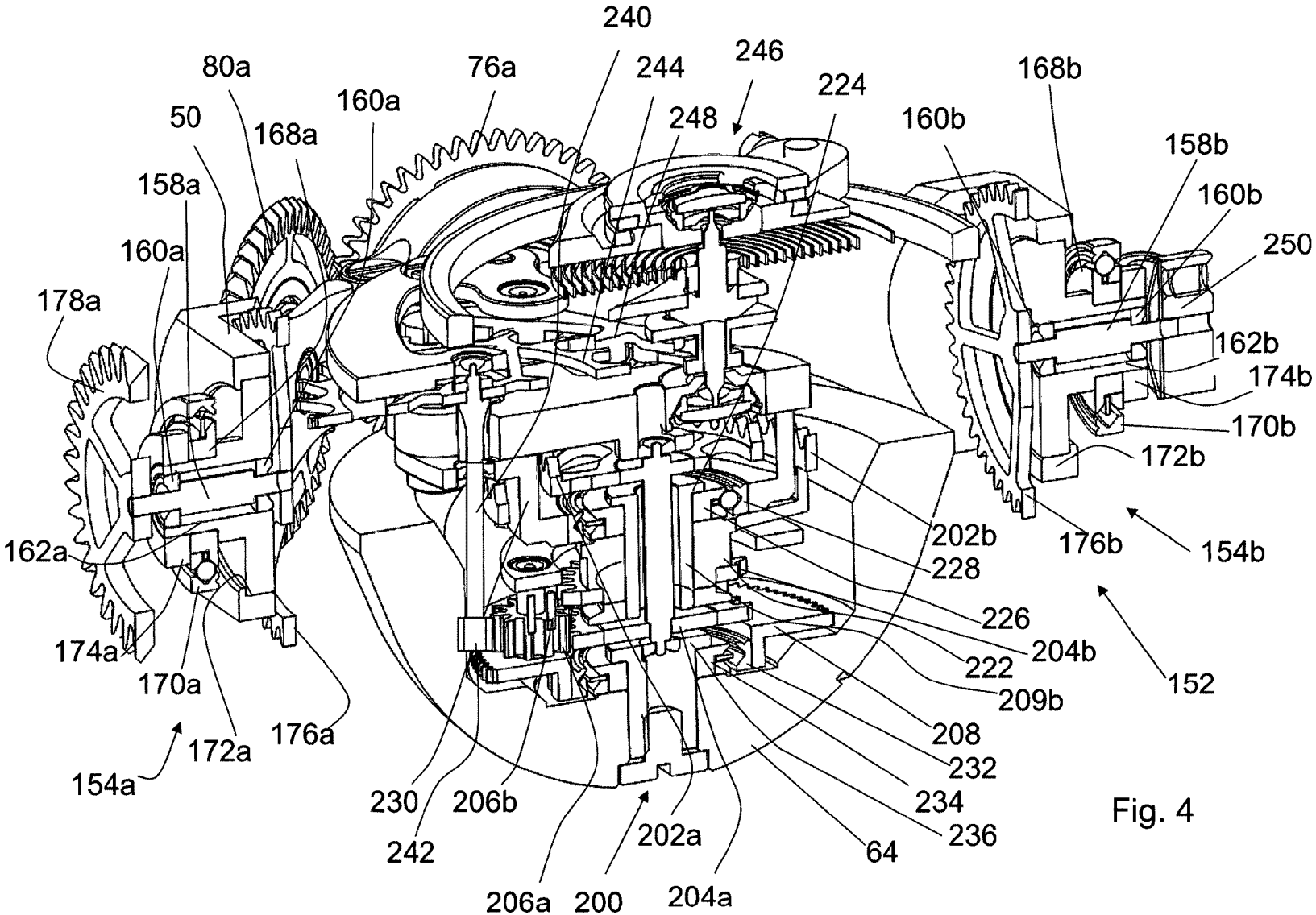

As more particularly shown in FIG. 4, the chassis 50 also includes a second pivoting system 152 around a second axis B-B, substantially perpendicular to the first axis A-A. The second pivoting system comprises two half-arbors 154*a* and 154*b*, positioned coaxially along the axis B-B. The construction of the half-arbors of the second pivoting system is similar to that described above. The elements of the second pivoting system are designated by reference numbers copying the reference numbers of the first pivoting system, preceded by a 1.

Each half-arbor 154*a*, 154*b* comprises a shaft 158*a*, 158*b* pivoting on two bearing blocks 160*a*, 160*b* positioned at the ends of a tube 162*a*, 162*b*, fastened in an opening 172*a*, 172*b* of the chassis 50. Each tube 162*a*, 162*b* receives, on its outer perimeter, a bearing, for example a ball bearing, whereof an inner ring 168*a*, 168*b* is fastened on the tube 162*a*, 162*b*, and whereof the outer ring 170*a*, 170*b* is positioned in a housing of the frame, not shown. A washer 174*a*, 174*b* closes the bearing. This second pivoting system makes it possible to pivot the chassis 50 relative to the frame.

Furthermore, each shaft 158*a*, 158*b* receives, at a proximal end in reference to the center of the chassis 50, a wheel 176*a*, 176*b*. We will return to the distal end of the shafts 158*a* and 158*b* later.

Each wheel 76*a*, 76*b* of the first pivoting system 52 forms a kinematic chain with a wheel 176*a*, 176*b* of the second pivoting system. There is thus a first kinematic chain between the wheels 76*a* and 176*a* of two half-arbors 54*a* and 154*a* of the first and second pivoting systems, respectively, and a second kinematic chain between the other wheels 76*b* and 176*b* of the other two half-arbors 54*b* and 154*b*.

Advantageously, these kinematic connections are respectively done by an intermediate wheel 80*a*, 80*b* mounted on the chassis 50. The intermediate wheel 80*a*, 80*b* is positioned substantially at 45° in reference to the wheels with which it meshes. Such an arrangement makes it possible for only that intermediate wheel 80*a*, 80*b* to include a toothing of a conical type, while the wheels 76*a*, 176*a*; 76*b*, 176*b*, respectively, have straight teeth. All of these wheels are planar. Such an embodiment is particularly interesting, compared to the configuration of the meshing between the wheels of the transmission and reference chains of the timepiece of the state of the art proposed in FIG. 1.

Preferably, the drive ratios of the first kinematic chain and the second kinematic chain are identical, such that the wheels 76*a* and 76*b* supported by the two half-arbors 54*a* and 54*b* of the first pivoting system 52 are driven at the same speed by the movements of the support 64. In one advantageous configuration, the wheels 76*a*, 76*b*, 176*a* and 176*b* of the pivoting systems 52*a* and 52*b* and the intermediate wheels 80*a* and 80*b* include the same number of teeth. They also have the same diameter. Through this configuration, the wheel 76*a* and the pinion 78*a* of a first half-arbor 54*a* of the first pivoting system 52 face those 76*b* and 78*b* of the other half-arbor 54*b* of that pivoting system. Seen from the center of the chassis 50, the pinions 78*a* and 78*b* are thus driven in opposite directions of rotation, at the same absolute velocity, without, however, being kinematically connected to each other by a gear train.

Thus, the relative rotations of the support 64 along the axes A-A in reference to the chassis 50 and the relative rotations of the chassis 50 in reference to the frame, along the axis B-B, are all transmitted to the pinions 78*a*, 78*b*, either directly or through kinematic chains.

Each of these pinions 78*a* and 78*b* meshes with an input of a differential 200, whereof the axes of rotation of the discs are parallel to those of the discs of the escapement. In other words, owing to the pivoting systems 52 and 152, the differential 200 is designed to have a substantially constant orientation, typically along a substantially vertical axis. More particularly, the pinion 78*a* meshes with a first plate 202*a* provided with a contrate toothing. This first plate 202*a* is secured to a first sun wheel 204*a* meshing with a first satellite 206*a* pivotably mounted on a satellite carrier 208. The latter is coaxial to the first sun wheel 204*a* and is capable of pivoting in reference to the other elements of the differential. The satellite carrier 208 is provided with a toothing and defines the output of the differential.

In parallel, the pinion 78*b* meshes with a second plate 202*b* provided with a contrate toothing. This second plate 202*b* is secured to a second sun wheel 204*b* meshing with a second satellite 206*b* pivotably mounted on the satellite carrier 208. The second satellite 206*b* is also arranged to mesh with the first satellite 206*a*.

Such a differential 200 configuration allows the output wheel, i.e., the satellite carrier 208, to transmit the average of the rotations received at its inputs. In light of the directions of rotations of the pinions 78*a* and 78*b* explained above, the first plate 202*a* and the second plate 202*b* rotate in different directions. The ratios between the pinions 78*a*, 78*b* and the plates 202*a* and 202*b* are calculated so that the plates rotate at the same absolute velocity. Thus, at the output of the differential 200, the rotations due to the movements of the support 64 cancel each other out, without using a specific reverser, the proposed construction according to the invention directly producing two opposite rotations at the inputs of the differential 200.

It may be noted that the proposed configuration allows great compactness of the differential. Owing to its configuration, it may easily be housed in a cavity of the support 64. These space gains offer the possibility of improving the pivoting of the elements of the differential 200. In fact, if the first plate 202*a* whereof the corresponding axis is situated at the center of the differential pivots on bearing blocks 210, the second plate 202*b* and the satellite carrier 208 are pivoted on bearings 212 and 214, respectively, for example ball bearings, fastened in ad hoc openings of the support 64.

The axis 209*a* of the first plate 202*a* is thus pivotably mounted between two bearing blocks 210, typically formed by stones. One is driven into a bar 216 supported by the support 64, and the other is driven into a tube 218, also fastened on the support 64, typically by a screw 220 inserted into the tube.

The second plate 202*b* is secured to a hub 222, comprising a central opening, passed through by the axis 209*b* of the second plate. The axis 209*b* of the second plate is adjusted in that central opening and is freely passed through by the axis 209*a* of the first plate. The axis 209*b* of the second plate has a collar 224 that defines a groove with a flank of the hub 222. An inner ring 226 of the ball bearing 212 is adjusted in the groove, while an outer ring 228 of that bearing is fastened on the additional bar 230 of the support 64. The second plate 202*b* is thus guided in rotation from the outside of its axis 209*b*. The second input of the differential is thus pivoted directly on the support 64.

Furthermore, the satellite carrier 208 is provided with a central opening, inside which an outer ring 232 of the bearing 214 is fastened. An inner ring 234 is positioned in a groove defined by the support 64 and a collar 236 included by the tube 218. The satellite carrier 208 is thus pivoted directly on the support 64. The bearing 214 is slightly raised relative to the bottom of the cavity of the support 64, so that the satellite carrier 208 does not rub on it. Such a construction of the differential makes it possible to improve the working conditions of the different elements. The output obtained is very good.

One of the wheels supported by one of the half-arbors is kinematically connected to the energy source. In the proposed example, it is a pinion 178*a* situated at the distal end of the shaft 158*a* of the second pivoting system that is engaged with the going train and that therefore makes it possible to bring the torque from the energy source to one of the inputs (in this case the first plate 202*a*) of the differential 200. The other input of the differential 200 does not receive the torque coming from the energy source. Given that, as mentioned above, the differential 200 takes the average of the rotations received at those inputs and the rotations due to the movement of the support 64 cancel each other out, the output of the differential 200, i.e., the satellite carrier 208, therefore only transmits a rotation induced by the torque provided by the energy source.

The satellite carrier 208 is kinematically connected to the escapement, as can particularly be seen in FIG. 4, using a shaft 240, provided on the one hand with an escapement pinion 242 meshing with the satellite carrier 208 and receiving the escapement wheel 244 on the other hand. The shaft 240 passes through the support 64, such that the adjusting organ 246 and the pallet 248 are situated on the upper side of the bridge and are situated at the periphery of the chassis so as to be visible by a user. To improve the compactness of the system, the escapement is of the angle type, i.e., the axes of the adjusting organ 246, the palette and the escapement wheel are not aligned. This makes it possible to bring the axis of the adjusting organ and that of the escapement wheel closer together.

It may also be noted that the half-arbor 154*b*, i.e., the half-arbor of the second pivoting system opposite that which is connected to the energy source, includes a blocking system in reference to the frame. A square or a brake-lever 250 can be fastened on the shaft, the rotation of which is in turn blocked in the frame. The rotations of the support 64 are thus indeed transmitted to the differential.

To assist the horizontal maintenance of the escapement, the support 64 can advantageously be ballasted. It defines an unbalance situated at a lower level relative to the axes of the pivoting systems, participating in the orientation of the support 64 and the chassis 50. It will be noted that the system more generally makes it possible to preserve a constant orientation of the escapement, independently of the position of the frame, that orientation being able to be not horizontal.

Thus, the timepiece described above makes it possible to optimize the construction relative to the state of the art. Not only are the different rotational movements related to the movements of the support 64 canceled out without using a reverser system, but additionally, the construction is simplified and improved, making it possible to reduce the sizing of the chassis 50. This is in particular due to the combination of several parameters.

Figure 1:
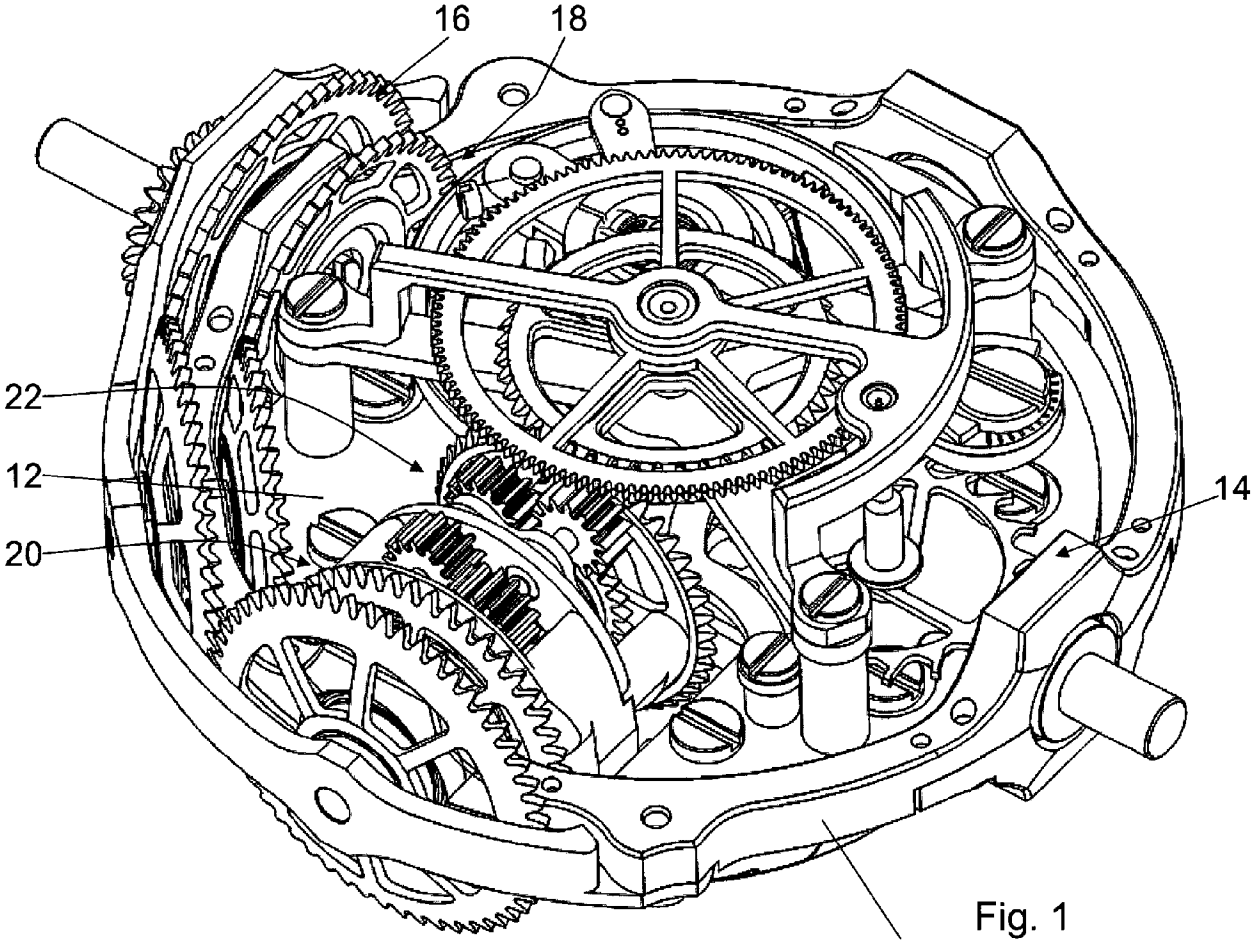
Fig. 1 Prior Art
FIG. 1 illustrates a timepiece part according to the state of the art.
Figure 2:
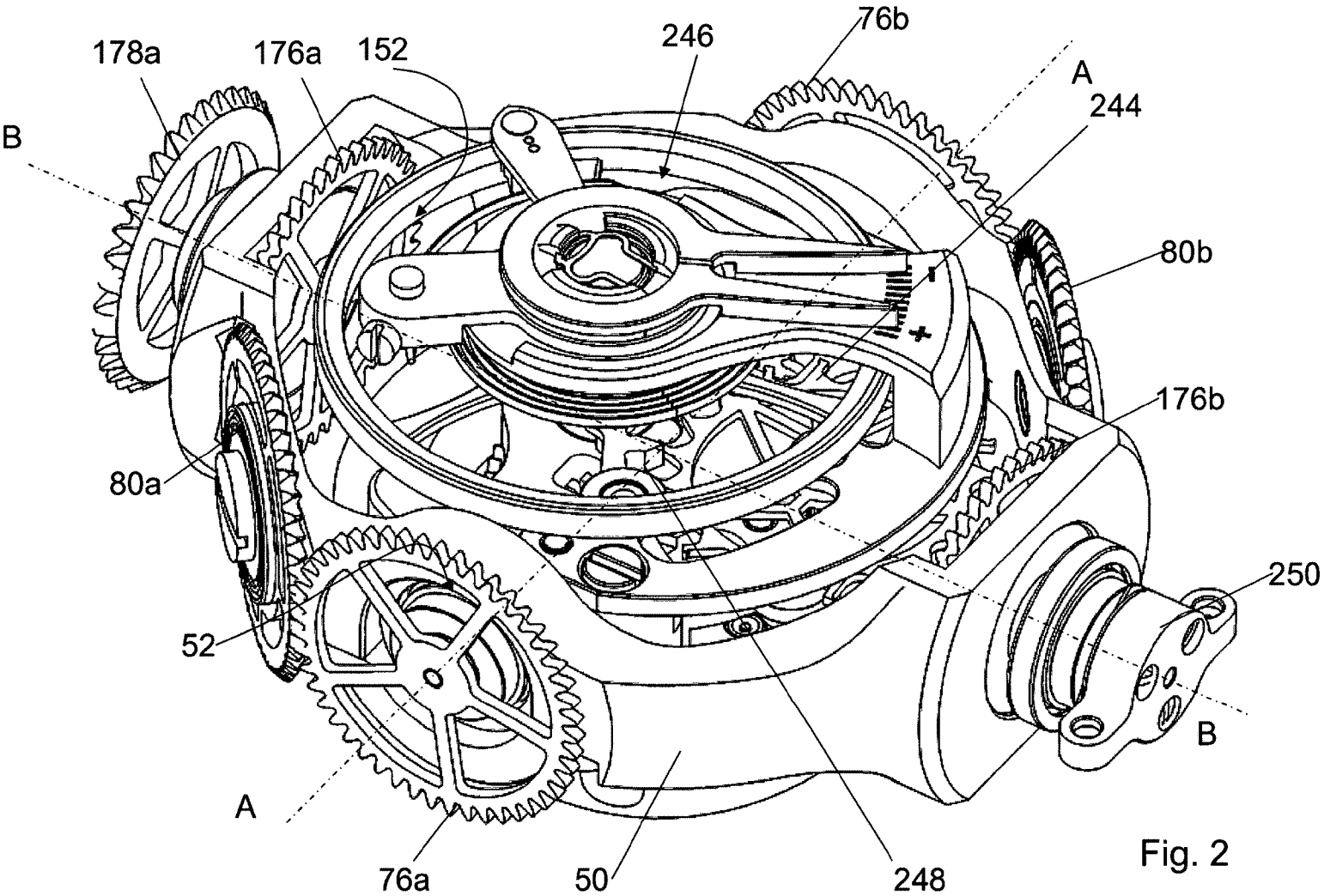
FIG. 2 shows a three-dimensional view of a timepiece part according to the invention.

Arranging the differential 200 along an axis parallel to the axes of the discs of the escapement makes it possible to reduce the diameter of the chassis 50. In fact, FIG. 1 shows that the axis of the differential was previously perpendicular to the axes of the discs of the escapement.

Furthermore, using an angle escapement also has a positive effect. This arrangement is made possible by the fact that the bar has a working surface whereof the size and free space make it possible to position the centering of the elements of the assortment relatively simply.

Furthermore, the construction of the chassis 50 and its pivoting means is also a source of improvement. In fact, the pivoting along the two axes A-A and B-B is done using a single chassis 50. The first pivoting system 52 serves as an interface between the chassis 50 and the support 64. It is positioned on the inner side of the chassis 50. The second pivoting system serves as an interface between the chassis 50 and the frame. It is positioned on the outer side of the chassis 50. The chassis 50 therefore includes two pairs of openings 72*a*, 72*b* and 172*a*, 172*b*, each pair respectively being situated on one of the axes A-A and B-B. For the axis A-A, the openings 72*a*, 72*b* are secured to the outer rings 70*a*, 70*b* of the bearings, while for the axis B-B, the openings 172*a*, 172*b* are secured to the inner rings 168, 168 of the bearings.

Figure 5:
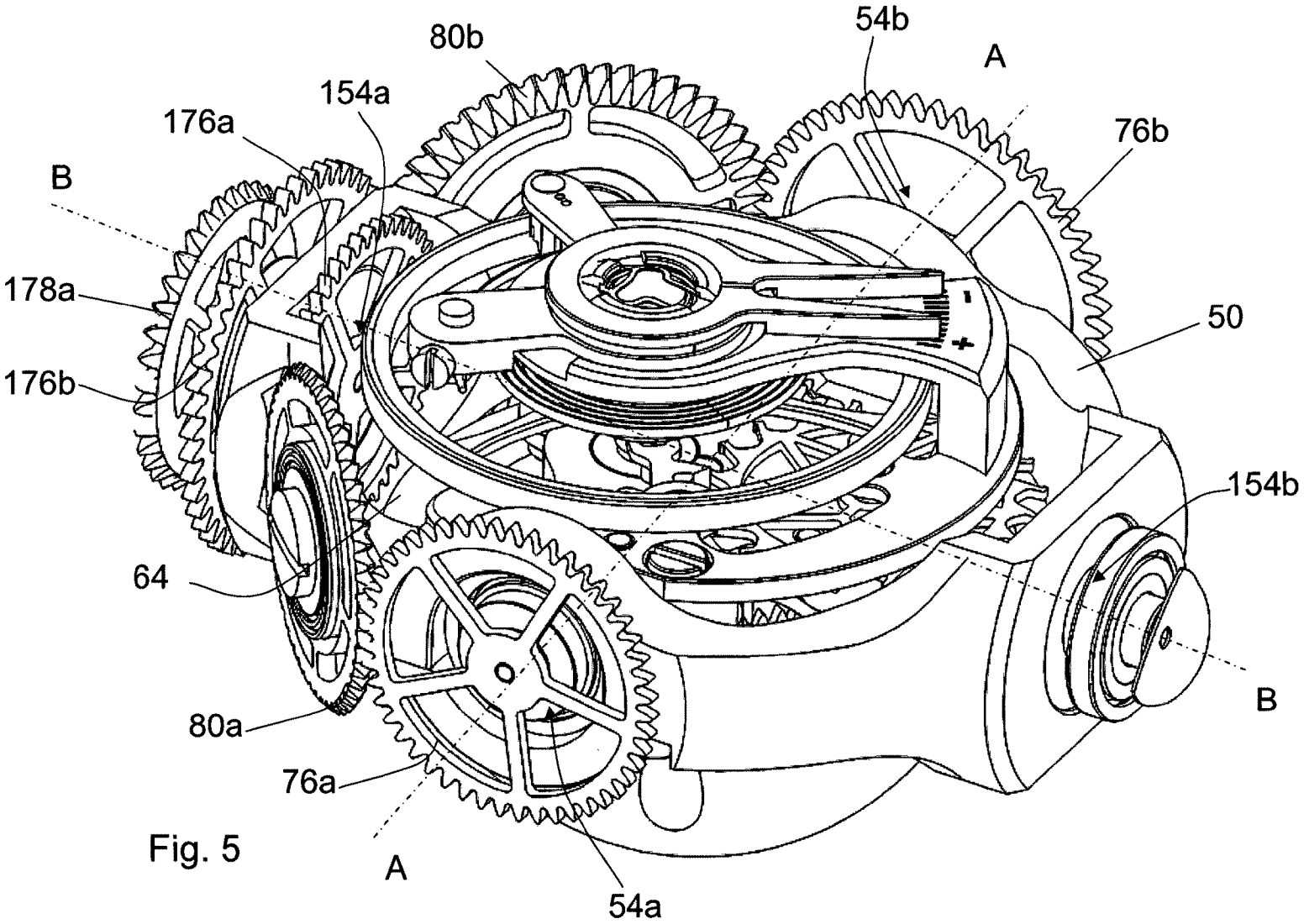

FIG. 5 proposes an alternative of a timepiece part according to the invention. To facilitate the reader's understanding and the comparison between the two alternatives, the identical or similar elements use the same reference numbers. The wheels 76*a* and 76*b* respectively supported by the half-arbor 54*a* and by the half-arbor 54*b* of the first pivoting system are respectively connected to a first input and a second input of a differential 200, identically to what was described above.

Like the first alternative, the wheel 76*a* forms a first kinematic chain with a first wheel 176*a* supported by a first half-arbor 154*a* of the second pivoting system 152. In the proposed embodiment, the wheel 176*a* is connected to the energy source, as will be described below.

The wheel 76*b* forms a second kinematic chain with a second wheel 176*b*, in this case coaxial to the first half-arbor 154*a* of the second pivoting system 152. In the proposed embodiment, the wheel 176*b* is stationary relative to the frame. In other words, the two wheels 176*a* and 176*b* are positioned coaxially on the first half-arbor 154*a*, but are mounted freely rotating relative to one another and relative to the chassis 50, the wheel 176*b* being stationary relative to the frame.

Thus, on the first half-arbor 154*a*, there is a pinion 178*a* kinematically connected to the energy source and secured in rotation with the wheel 176*a*. It will be noted that it is possible to reverse the functions of the wheels 176*a* and 176*b* and to have the wheel 176*b* kinematically connected to the energy source and the wheel 176*a* stationary relative to the frame. In this embodiment, the second half-arbor 154*b* is a simple pivoting system of the chassis 50 relative to the frame.

In the example proposed in FIG. 5 and non-limitingly, the wheels 176*a* and 176*b* are positioned on either side of the wall of the chassis 50. According to a configuration similar to that which was described above, the wheel 176*a* meshes with an intermediate wheel 80*a*, engaged with the wheel 76*a*, while the wheel 176*b* meshes with an intermediate wheel 80*b*, engaged with the wheel 76*b*. If applicable, the chassis 50 is arranged so as to leave the gear of the discs of the kinematic chains free. This makes this alternative a bit less compact than the first. It will be noted again that, in the proposed example, the wheels 176*a* and 176*b* have different sizes. However, preferably, the drive ratios of the wheels 76*a* and 76*b* supported by the two half-arbors of the first pivoting system 52 are identical, such that they are driven at the same absolute velocity by the movements of the support 64. It is also possible to provide that the wheels 76*a*, 76*b* and 176*a*, 176*b* of the first pivoting system 52 and the second pivoting system 152 and the intermediate wheels 80*a*, 80*b* include the same number of teeth.

In the two alternatives above, it is possible to provide that the wheels 76*a* and 76*b* are not driven at the same velocity, by adapting the gear ratios at the differential, i.e., by having different gear ratios between the first input and the output, on the one hand, and between the second input and the output, on the other hand, so that the movements of the chassis are indeed offset by the differential.

Thus proposed is a timepiece part whereof the operation is freed of the influence of its orientation variations, having an improved construction relative to the state of the art. It can also be noted that one of the advantages of the proposed system is that it is self-balancing. In fact, any torque induced by the transmission of energy at the kinematic chain that is connected to the energy source causes a counter-torque at the other kinematic chain. Thus, if the chassis were to be in a vertical position along the axis B-B, in which the counterweight could not balance the chassis, the self-balancing makes it possible to prevent the chassis from beginning to rotate around the axis B-B. The present description was provided solely as an illustration of the invention. In particular, regarding the intermediate wheels of the kinematic chains, it is quite possible to consider directly connecting the wheels 76*a* and 176*a*, on the one hand, and the wheels 76*b* and 176*b*, on the other hand, or on the contrary to increase the number of intermediate wheels.

The invention claimed is:

1. A timepiece part including:

a frame supporting an energy source, a chassis comprising a support pivotably mounted inside said chassis around a first axis by a first pivoting system comprising first and second coaxial half-arbors, said chassis being pivotably mounted with respect to the frame around a second axis substantially perpendicular to the first axis by a second pivoting system comprising first and second coaxial half-arbors, and an escapement arranged on said support, the escapement comprising an escapement wheel and an escapement pinion connected with a shaft, wherein a first wheel supported by the first half-arbor of the first pivoting system forms a first gear train with a second wheel supported by the first half-arbor of the second pivoting system, and wherein a first wheel supported by the second half-arbor of the first pivoting system forms a gear train with a a second wheel supported by the first or second half-arbor of the second pivoting system, wherein:

one of the wheels supported by the second pivoting system is kinematically connected to the energy source, and the other wheel supported by that pivoting system is stationary relative to the frame, and both wheels supported by the first pivoting system are kinematically connected with an input of a differential comprising transmission discs having a common axis of rotation being parallel to the shaft of the escapement, said differential being mounted on said support, said differential being arranged to transmit, at its output, the average of the rotations received at its inputs, said output being kinematically connected to the escapement, wherein, at the output of the differential, the rotations due to the movements of the support cancel each other out, said differential producing at its inputs two opposite rotations without any inverter such that, together with the pivoting systems, the differential maintains a substantially constant orientation.

2. The timepiece part according to claim 1, wherein the drive ratios of the first kinematic chain and the second kinematic chain are identical.

3. The timepiece part according to claim 2, wherein the second wheel of the second kinematic chain is supported by the second half-arbor of the second pivoting system.

4. The timepiece part according to claim 2, wherein the second wheel is supported by the first half-arbor of the second pivoting system.

5. The timepiece part according to claim 2, wherein the half-arbors of the first pivoting system further include a pinion engaged with an input of the differential.

6. The timepiece part according to claim 2, wherein one of the wheels of the second pivoting system is kinematically connected to the energy source.

7. The timepiece part according to claim 6, wherein the wheel of the second pivoting system that is not kinematically connected to the energy source comprises a blocking system in reference to the frame.

8. The timepiece part according to claim 1, wherein the second wheel of the second kinematic chain is supported by the second half-arbor of the second pivoting system.

9. The timepiece part according to claim 1, wherein the second wheel is supported by the first half-arbor of the second pivoting system.

10. The timepiece part according to claim 1, wherein the half-arbors of the first pivoting system further include a pinion engaged with an input of the differential.

11. The timepiece according to claim 10, wherein the first input and the second input of the differential are respectively secured to a first sun wheel and a second sun wheel, respectively meshing with a first satellite and with a second satellite, said satellites being pivotably mounted on a satellite carrier and meshing with each other, said satellite carriers being coaxial with said sun wheels and defining the output of the differential.

12. The timepiece part according to claim 11, wherein the satellite carrier is kinematically connected to the escapement, using a shaft, provided on the one hand with an escapement pinion kinematically connected with the satellite carrier, and on the other hand receiving the escapement wheel.

13. The timepiece part according to claim 12, wherein the wheels of the first pivoting system and the second pivoting system and the intermediate wheels include the same number of teeth.

14. The timepiece part according to claim 1, wherein one of the wheels of the second pivoting system is kinematically connected to the energy source.

15. The timepiece part according to claim 14, wherein the wheel of the second pivoting system that is not kinematically connected to the energy source comprises a blocking system in reference to the frame.

16. The timepiece according to claim 1, wherein one of the inputs of the differential and the satellite carrier is pivoted directly on the support.

17. The timepiece part according to claim 1, wherein the escapement is an angle escapement.

18. The timepiece part according to claim 1, wherein the first pivoting system and the second pivoting system cooperate with a single chassis.

19. The timepiece part according to claim 1, arranged such that any torque induced by the transmission of energy at the kinematic chain that is connected to the energy source induces a counter-torque at the other kinematic chain.

20. A timepiece part comprising:

a frame supporting an energy source;

a chassis comprising a support pivotably mounted inside said chassis around a first axis by a first pivoting system comprising first and second coaxial half-arbors, said chassis being pivotably mounted with respect to the frame around a second axis substantially perpendicular to the first axis by a second pivoting system comprising first and second coaxial half-arbors; and an escapement arranged on said support, the escapement comprising an escapement wheel and an escapement pinion connected with a shaft, wherein a first wheel supported by the first half-arbor of the first pivoting system forms a first gear train with a second wheel supported by the first half-arbor of the second pivoting system, wherein a first wheel supported by the second half-arbor of the first pivoting system forms a gear train with a second wheel supported by the first or second half-arbor of the second pivoting system, wherein i) one of the wheels supported by the second pivoting system is kinematically connected to the energy source, and the other wheel supported by that pivoting system is stationary relative to the frame, and ii) both wheels supported by the first pivoting system are kinematically connected with an input of a differential comprising transmission discs having a common axis of rotation being parallel to the shaft of the escapement, said differential being arranged to transmit, at its output, the average of the rotations received at its inputs, said output being kinematically connected to the escapement, wherein the half-arbors of the first pivoting system further include a pinion engaged with an input of the differential, wherein the first input and the second input of the differential are respectively secured to a first sun wheel and a second sun wheel, respectively meshing with a first satellite and with a second satellite, said satellites being pivotably mounted on a satellite carrier and meshing with each other, said satellite carriers being coaxial with said sun wheels and defining the output of the differential, wherein the satellite carrier is kinematically connected to the escapement, using a shaft, provided on the one hand with an escapement pinion kinematically connected with the satellite carrier, and on the other hand receiving the escapement wheel, and wherein said shaft crosses through the support, such that an adjusting organ and a pallet of the escapement are positioned at the periphery of the chassis.

21. A timepiece part comprising:

a frame supporting an energy source;

a chassis comprising a support pivotably mounted inside said chassis around a first axis by a first pivoting system comprising first and second coaxial half-arbors, said chassis being pivotably mounted with respect to the frame around a second axis substantially perpendicular to the first axis by a second pivoting system comprising first and second coaxial half-arbors; and an escapement arranged on said support, the escapement comprising an escapement wheel and an escapement pinion connected with a shaft, wherein a first wheel supported by the first half-arbor of the first pivoting system forms a first gear train with a second wheel supported by the first half-arbor of the second pivoting system, wherein a first wheel supported by the second half-arbor of the first pivoting system forms a gear train with a a second wheel supported by the first or second half-arbor of the second pivoting system, wherein i) one of the wheels supported by the second pivoting system is kinematically connected to the energy source, and the other wheel supported by that pivoting system is stationary relative to the frame, and ii) both wheels supported by the first pivoting system are kinematically connected with an input of a differential comprising transmission discs having a common axis of rotation being parallel to the shaft of the escapement, said differential being arranged to transmit, at its output, the average of the rotations received at its inputs, said output being kinematically connected to the escapement, and wherein the first kinematic chain and the second kinematic chain further include an intermediate wheel mounted on the chassis, said intermediate wheel being positioned substantially at 45° relative to the wheels of the first pivoting system and the second pivoting system, respectively.

22. The timepiece part according to claim 21, wherein said intermediate wheel includes a conical-type toothing of the first pivoting system and the second pivoting system, respectively, having straight teeth.

* * * * *